United States Patent [19]

Arronte

[11] 4,452,403

[45] Jun. 5, 1984

[54] DISPENSER FOR MATERIAL ARRANGED IN A ROLL

[76] Inventor: Ernesto Arronte, 360 Williamson St., Elizabeth, N.J. 07201

[21] Appl. No.: 437,198

[22] Filed: Oct. 28, 1982

[51] Int. Cl.[3] ..... B65H 19/02

[52] U.S. Cl. ..... 242/55.2; 242/68.4

[58] Field of Search ..... 242/55.2, 55.3, 55.42, 242/55.53, 55.54, 55.55, 68.4, 129.51, 129.53; 206/397, 389

[56] References Cited

U.S. PATENT DOCUMENTS

| | | | |
|---|---|---|---|
| 1,651,867 | 12/1927 | Boynton | 242/55.2 |
| 2,555,885 | 6/1951 | Hope | 242/55.53 |
| 2,643,069 | 6/1953 | Carlin | 242/55.53 |
| 2,889,122 | 6/1959 | McConnell | 242/55.2 |
| 3,022,957 | 2/1962 | Blunt et al. | 242/55.2 |
| 3,034,738 | 5/1962 | Kuhn | 242/55.2 |
| 3,038,676 | 6/1962 | Mayer | 242/55.2 |
| 3,051,404 | 8/1962 | Ritchey | 242/55.2 |
| 3,138,340 | 6/1964 | Caravella | 242/55.2 |
| 3,304,034 | 2/1967 | Jones | 242/55.2 X |
| 3,878,998 | 4/1975 | Lazzari | 242/55.2 |

FOREIGN PATENT DOCUMENTS

| | | | |
|---|---|---|---|
| 652245 | 9/1964 | Belgium . | |
| 415612 | 8/1940 | Fed. Rep. of Germany | 242/129.51 |
| 1047023 | 12/1953 | France | 242/129.51 |
| 1385090 | 2/1975 | United Kingdom . | |

*Primary Examiner*—Stuart S. Levy
*Assistant Examiner*—Scott J. Haugland
*Attorney, Agent, or Firm*—James M. Trygg

[57] ABSTRACT

A dispenser for material or articles arranged in a roll is disclosed having articulated end pieces that loosely engage the central opening of the roll and hold the roll in position for dispensing. The end pieces are pivotally attached to the frame of the dispenser and are spring biased to urge them into engaging position.

6 Claims, 5 Drawing Figures

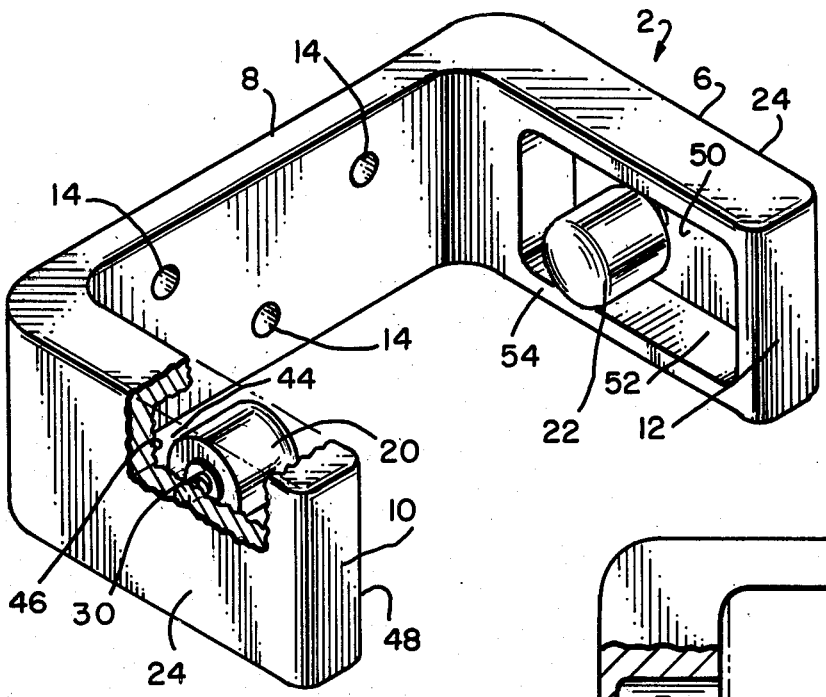
FIG. 1
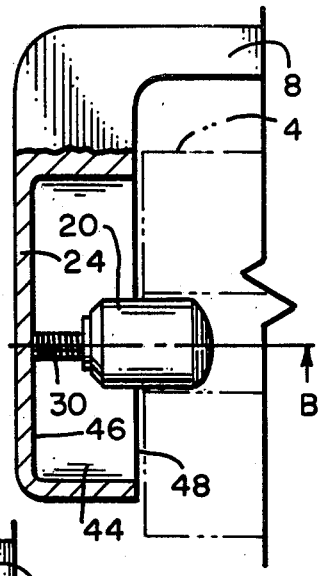
FIG. 5
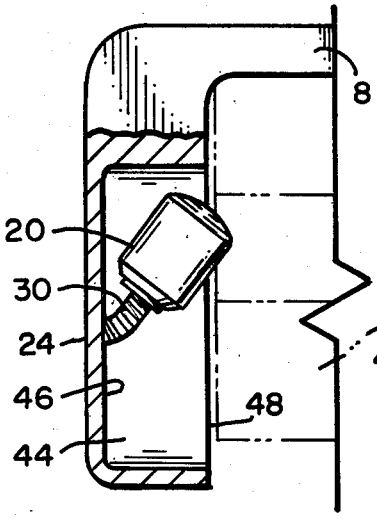
FIG. 4
FIG. 3
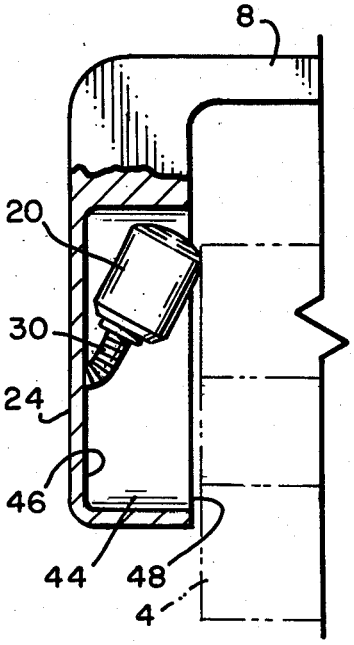
FIG. 2
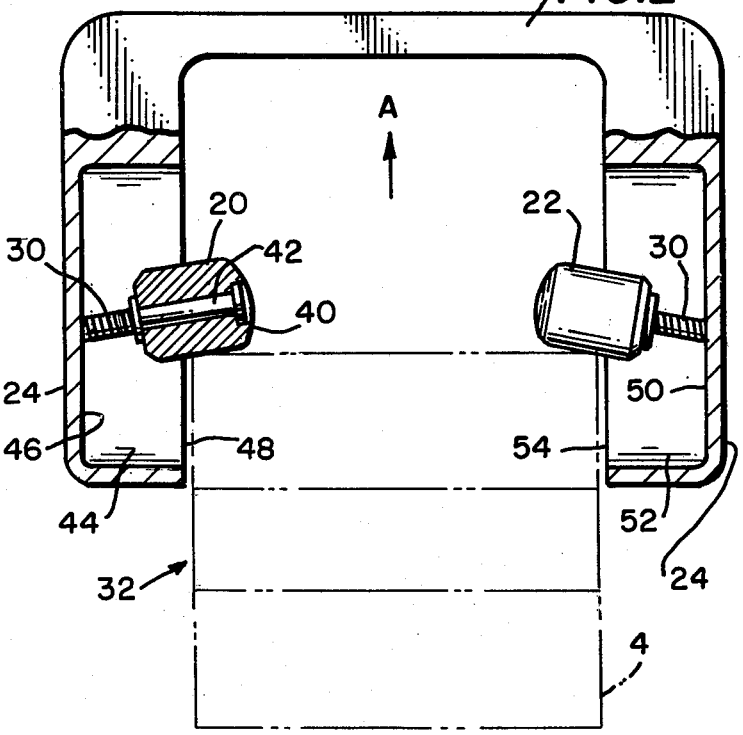

DISPENSER FOR MATERIAL ARRANGED IN A ROLL

BACKGROUND OF THE INVENTION

This invention relates to material or acticle dispensers and particularly to dispensers for material or articles arranged in a roll such as toilet tissue, paper towels, plastic food wrap, or the like. The prior art contains numerous such dispensers of many different designs. One of the more common arrangements utilizes a generally U-shaped bracket, or frame, having a collapsble or flexible spindle member supported between the two free ends of the bracket. The collapsable or flexible spindle is inserted through the central opening of the roll, manually manipulated by collapsing or deflecting, then made to attachably engage the two free ends of the bracket. This procedure is cumbersome to perform for most people and even impossible to perform for persons having certain handicaps or physical disabilities. Another common arrangement, frequently utilized for paper towel rolls, consists of an elongated member adapted for attaching to a wall, or the like, having two parallel arms, one at each end, projecting outwardly. Each arm has a fixed protrusion at its extremity, the two arms being arranged so that their respective protrusions are mutually opposed. The fixed protusions project into each end of the central opening of the roll loosely holding it in position for dispensing paper towels. With this arrangement, one or both of the arms are adapted to pivot or hinge at their attachment point to the elongated member so that a roll may be inserted then the pivoted arm may be swung into engagement with the roll and held in place by a latch device or spring member. Another, similar arrangement utilizes deformable or deflectable arms. With this type of dispenser, a force is manually applied to the deformable arm in such a way that it is deflected away from the other arm so that the roll may be inserted. The procedure for inserting a roll and removing the core in both arrangements, like the toilet tissue dispenser, is cumbersome for most people and for some may be impossible. Every similar prior art dispensing device known to this inventor, requires the use of both hands to properly insert a roll.

What is needed is a dispenser for materials arranged in a roll wherein the roll may be easily inserted or removed with one hand.

It is therefore an object of this invention to provide a dispenser for material or articles arranged in a roll wherein the roll may be easily inserted and removed.

It is another object of this invention to provide such a dispenser wherein the roll may be inserted or removed with one hand.

SUMMARY OF THE INVENTION

According to the present invention there is shown a dispenser for material arranged in a roll for unwinding such as toilet tissue, plastic articles, or the like. The dispenser has a frame and a holder means for holding the roll and permitting rotation thereof about an axis of rotation. The holder means comprises a pair of articulated end pieces pivotally attached to the frame on points coincident with the axis of rotation of the roll. The free ends of the end pieces are mutually opposed, in alignment along the axis of rotation of the roll, and separated by a distance substantially smaller than the width of the roll. Resilient means is provided for urging the free ends of the end pieces into this position.

BRIEF DESCRIPTION OF THE DRAWINGS

Other objects and advantages will become apparent upon reading the following detailed description in conjunction with the accompanying drawings in which:

FIG. 1 is a perspective view of a dispenser incorporating the teachings of this invention;

FIG. 2 is a plan view, partly in section of the dispenser shown in FIG. 1 wherein a roll of toilet tissue is partially inserted into the dispenser;

FIG. 3 is a partial plan view similar to FIG. 2 wherein the roll is further inserted;

FIG. 4 is similar to FIG. 3 except that the roll is further inserted; and FIG. 5 is similar to FIG. 2 except that the roll of toilet tissue is fully inserted into the dispenser.

DESCRIPTION OF THE PREFERRED EMBODIMENT

Referring to FIGS. 1 through 5 there is shown a dispenser 2 in conjunction with a toilet tissue roll 4. The dispenser 2 includes a U-shaped bracket 6 comprising a base 8 and two spaced apart arms 10 and 12 projecting therefrom. The two arms 10 and 12 being parallel and of substantially equal length, are joined to the base 8 to form a rigid U-shaped structure. The base 8 contains suitable mounting holes 14 for accepting screw fasteners, or the like, not shown, for attaching the bracket 6 to a mounting surface. The two arms 10 and 12 are of a length somewhat greater than one half the diameter of the roll 4, as can be best seen in FIG. 5, and are sufficiently apart to loosely receive the roll therebetween.

A pair of articulated end pieces 20 and 22 are pivotally attached to the ends 24 of the arms 10 and 12 respectively. This pivotal attachment is effected through a pair of resilient members 30. Coil springs having a generally cylindrical shape will function well here. Each resilient member 30 has one end rigidly attached to an arm 10, 12, and the other end attached to an end piece 20,22 so that the end piece may rotate with respect to the resilient member 30. The end pieces 20 and 22 are adapted to loosely engage each end of the central opening 23 of the roll 4 firmly holding the roll in position while permitting rotation thereof about the approximate axis of the central opening. The resilient members 30 are of sufficient stiffness along their longitudinal dimension to resist the normal forces encountered during the dispensing operation without undergoing substantial deflections.

As can be seen in FIG. 2, the articulated end piece 20 is of cylindrical shape having a rounded end 40, or free end, facing into the roll 4 and is journaled for rotation on an axle 42. The end of the axle 42 facing away from the rounded end 40 is rigidly attached to an end of the resilient member 30. A cavity 44 having a sidewall 46 is formed in the inside wall 48 of the arm 10 and is of cup-like shape having its opening facing the roll 4. The other end of the resilient member 30 is attached to the side wall 46. The end piece 22 is also of cylindrical shape, similar to that of the end piece 20. The end piece 22, having a rounded end 40, or free end, is attached to the innermost wall 50 of a cavity 52 formed in the sidewall 54 of the arm 12 through a resilient member 30 and axle 42 in a manner similar to that of the end piece 20. It is pointed out that the pivotal attachment of the end pieces may be effected by a conventional pin and clevis arrangement in place of the resilient member 30. Such alternative structures are considered within the scope and spirit of this invention.

With this arrangement, the end piece 20 may be deflected in a direction indicated by A in FIG. 2 by manually urging the roll 4 into contact with the end pieces 20 and 22 at the points 50. As the roll 4 is further urged in the direction A, the resilient members 30 deflect further thereby causing the end pieces 20 and 22 to pivot away from the roll 4 and toward the cavities 44 and 52 respectively. The cavities 44 and 52 are sufficiently deep to permit the end pieces 20 and 22 to fully enter thereby allowing the sides 60 of the roll 4 to pass therebetween, as shown in FIG. 3. As the roll 4 continues to move in the direction indicated by A, the axis of the central opening 32 comes into approximate alignment with the two articulated end pieces 20 and 22, thereby permitting the end pieces 20, 22 to partially enter the central opening as indicated in FIG. 4. Only the left side of the dispenser 2 is shown in FIG. 4. A slight further movement of the roll 4 in the direction indicated by A permits the two end pieces 20 and 22 to rapidly enter the central opening 32 with a snapping action and loosely retain the roll 4 within the U-shaped dispenser as shown in FIG. 5.

The roll 4 may be removed from the dispenser 2 by simply urging it in a direction opposite that indicated by A. The two end pieces 20 and 22 will pivot outwardly, in a manner similar to that described above, for inserting the roll permitting the removal of the roll.

When the roll 4 is held within the dispenser 2, as shown in FIG. 5, a line B passing through the centers of the end pieces 20 and 22 defines the center line or axis about which the roll 4 may rotate. The line B further defines a neutral position of alignment with respect to which the centers of the end pieces 20 and 22 are urged into a coincident relationship by the resilient members 30. The present embodiment describes the resilient member 30 as being a cylindrical shaped coil spring the axis of which coincides with the line B. Other alternative structures, however, are envisioned by the inventor and will be apparent to those skilled in the art upon reading this disclosure. Such alternative structures include, but are in no way limited to, flat, tubular and wire structures or various combinations of such structures by themselves or in combination with a coil spring. A primary requirement of these structures is to provide sufficient rigidity to the end pieces 20 and 22 while in the neutral position so that the normal forces encountered during operation of the dispenser will not significantly deflect the end pieces 20 and 22. It is a further primary requirement of these structures to permit pivoting of the end pieces 20 and 22 so that they may be deflected completely out of the path of the roll 4 for insertion or removal thereof.

Accordingly, there has been disclosed a dispensing device for material or articles arranged in a roll wherein the roll may be easily inserted or removed using only one hand and without the use of complex and costly latching or telescoping devices which are common in the prior art today. It is understood that the above described embodiment is merely illustrative of the application of the principles of this invention. Upon reviewing the present disclosure numerous other embodiments may be devised by those skilled in the art without departing from the spirit and scope of this invention, as defined by the appended claims.

I claim:

1. A dispenser for material arranged in a roll for unwinding such as toilet tissue, paper, plastic articles, or the like, said dispenser having a frame and a holder means for holding said roll and permitting rotation thereof about an axis of rotation, said holder means comprising a pair of articulated end pieces pivotally attached to said frame on points coincident with said axis of rotation and arranged so that their free ends are mutually opposed, in alignment along said axis of rotation, and separated by a distance substantially smaller than the width of said roll, said pair of end pieces being further arranged to loosely engage said roll, and resilient means for effecting said pivotal attachment and for urging said free ends of said end pieces into said alignment, wherein said end pieces are further arranged so that upon application of a predetermined force thereto said free ends deflect laterally out of said alignment.

2. The dispenser as set forth in claim 1 wherein the distance separating said free ends while deflected is sufficiently large to permit passage of said roll therebetween.

3. The dispenser as set forth in claim 2 wherein said end pieces are journaled for rotation with respect to said resilient means.

4. The dispenser as set forth in claim 3 wherein said resilient means includes a coil spring.

5. The dispenser as set forth in claim 3 wherein said resilient means is only a coil spring.

6. A dispenser for material arranged in a roll for unwinding such as toilet tissue, paper, plastic articles, or the like, said dispenser having a frame an a holder means for holding said roll and permitting rotation thereof about an axis of rotation, said holder means comprising a pair of articuated end pieces pivotally attached to said frame on points coincident with said axis of rotation and arranged so that their free ends are mutually opposed, in alignment along said axis of rotation, and separated by a distance substantially smaller than the width of said roll, and resilient means for urging said free ends of said end pieces into said alignment, wherein said end pieces are journaled for rotation with respect to said resilient means and are further arranged so that upon application of a predetermined force thereto said free ends deflect laterally out of said alignment.

* * * * *